United States Patent [19]

Rassmann et al.

[11] Patent Number: 4,715,659

[45] Date of Patent: Dec. 29, 1987

[54] MINERAL MINING INSTALLATIONS

[75] Inventors: Christoph Rassmann, Lünen; Gerhard Nickel, Selm; Bernd Steinkuhl; Gerhard Merten, both of Lünen; Egon Pfefferle, Hamm, all of Fed. Rep. of Germany

[73] Assignee: Gewerkschaft Eisenhutte Westfalia GmbH, Lunen, Fed. Rep. of Germany

[21] Appl. No.: 907,940

[22] Filed: Sep. 16, 1986

[30] Foreign Application Priority Data

Sep. 17, 1985 [DE] Fed. Rep. of Germany ..... 3533107
May 27, 1986 [DE] Fed. Rep. of Germany ..... 3617737

[51] Int. Cl.[4] ..... E21C 35/20
[52] U.S. Cl. ..... 299/43; 299/34
[58] Field of Search ..... 299/34, 43

[56] References Cited

U.S. PATENT DOCUMENTS 4,205,882 6/1980 Hauschopp et al. ..... 299/43
4,391,471 7/1983 Hauschopp et al. ..... 299/43
4,474,411 10/1984 Peters et al. ..... 299/43
4,607,890 8/1986 Merten et al. ..... 299/43

FOREIGN PATENT DOCUMENTS 1205927 12/1965 Fed. Rep. of Germany ..... 299/34
2621382 12/1977 Fed. Rep. of Germany .

*Primary Examiner*—James A. Leppink
*Assistant Examiner*—Terry Lee Melius
*Attorney, Agent, or Firm*—Sughrue, Mion, Zinn, Macpeak & Seas

[57] ABSTRACT

A mineral mining installation employs a scraper-chain conveyor constructed from individual pans joined end-to-end and a plough having a drive plate running beneath the conveyor and on a skid bed formed as a sub-frame structure on the floor of the working. The drive plate is connected via guide means to the haulage run of a chain in a lower guide passage at the side of the conveyor opposite to the plough. An upper guide passage accommodates the return run of the chain. The passages are defined by a guide structure fitted to the side walls of the pans and includes detachable covers which can be removed for access purposes. At least some of the covers are linked with the sub-frame structure with the aid of tongue-and-groove connections. These connections permit limited movement of the pans and guide structure relative to the sub-frame structure longitudinally of the conveyor and limited raising and tilting movements of the side walls of the pans opposite the machine and the covers relative to the sub-frame structure as the drive plate passes along the conveyor.

18 Claims, 11 Drawing Figures

MINERAL MINING INSTALLATIONS

FIELD OF THE INVENTION

The present invention relates to mineral mining installations. More particularly, the invention is concerned with installations with a scraper-chain conveyor and a winning machine or plough which is propelled back and forth alongside the conveyor to strip mineral, e.g. coal, from a mineral face.

BACKGROUND TO THE INVENTION

Installations of the aforementioned kind are known in which the plough is provided with a drive plate, the socalled sword plate, projecting beneath the conveyor. The drive plate is coupled to a chain running inside guide passages at the goaf side, i.e. the side of the conveyor remote from the mineral face. The passages are defined by a structure which includes detachable covers which screenoff the passages laterally. The covers can be removed for access purposes. The drive plate slides on skid plates resting on the floor and forming a sub-frame beneath the conveyor. As the drive plate moves beneath the individual channel sections or pans it raises these to a limited extent relative to the sub-frame as it passes. To accommodate this movement it is known from German Patent Specification No. P 1 205 927 to form pivot connections between the covers and the sub-frame structure.

It is also known to provide upstanding brackets on the sub-frame which are linked to the covers with pivot joints. Another known installation of this type is described in German Patent Specification No P26 21 382. This installation has upstanding flanges on the sub-frame which themselves cover the chain guide passages laterally and which are articulated to the conveyor pans. Advancing rams and hydraulic control units for controlling the attitude of the plough can be connected to flanges or to the brackets in these known constructions.

The prior art installations suffer from certain disadvantages. The passage of the plough drive plate is not always reliably accommodated especially where the floor or the working is uneven. The access to the drive chain in the guide passages is not easily facilitated especially in the cramped conditions encountered in shallow seams where space to manoeuvre the components is restricted. Also under such conditions it is difficult to keep the installation within a sufficiently low height overall to permit general access for personnel.

A general object of the present invention is to provide an improved mineral mining installation.

SUMMARY OF THE INVENTION

An installation constructed in accordance with the invention has a scraper-chain conveyor with individual channel sections or pans interconnected end-to-end for limited mobility therebetween. A floor sub-frame structure is disposed beneath the pans to provide a sliding skid-like surface for the drive plate of a plough. The drive plate passes over the sub-frame and beneath the pans in succession. A guide structure at the side of the conveyor opposite the plough defines upper and lower passages for a drive chain coupled in the lower run to the drive plate. The passages are closed at the side opposite the conveyor with the aid of detachable covers. In accordance with the invention, connection means serves to connect at least some of the covers to the sub-frame structure to permit both limited raising and tilting movements of the sides of the pans and the passagedefining means as the drive plate passes. Preferably the connection means also accommodates limited movements longitudinally of the conveyor as well. In a preferred form the connection means can be realized by a tongue-and-groove connections with adequate clearance between the tongues and grooves. To inhibit the tongues from becoming detached from the grooves it is preferable to use a locking or holding means and this can take the form of individual locking bars detachably mounted to the subframe and overlapping, at least in part, flanges or lugs on the covers. The locking bars can be stout components equipped with connectors or adapted otherwise for fixing shifting or bracing rams for example.

Only covers at the end regions of the pans need have the tongue-and-groove connections with the sub-frame structure.

By releasing the locking bars the covers can be easily removed usually after detaching fixing bolts securing these to the pan side walls.

An installation constructed in accordance with the invention is simplified in its overall construction and the tongue-and-groove connections can be fabricated without difficulty. Such connections also ensure that only a slight lifting of a cover is necessary for detachment and this makes the installation particularly useful to win thin seams of small height. The tongue-and-groove connections, moreover, are well adapted to cope with uneven floor levels and in situations where the mine working is curved.

Although the tongue-and-groove connections can be upstanding they can also be inclined. The tongues may be on the covers of the grooves in the sub-frame or vice versa. Preference is given to the formation of the connections on stout base units, usually castings, at the end regions of the pans welded to skid plates allocated one to each pan, and forming themselves part of the sub-frame. These base units can also have hook-like projections which receive links to interconnect the skid plates and base units.

Preferably three covers are allocated to each pan with only the end covers having the tongue-and-groove connections. The central cover may be spaced from an upstanding bracket fixed to the sub-frame and forming a central console to which a shifting ram and a control unit used to tilt the installation to alter the attitude of the plough can be fitted.

It is sometimes helpful to limit the angle through which the pan goaf side walls and the covers can tilt and stop means can be located between the central covers and the brackets of the sub-frame.

The invention may be understood more readily, and various other features and aspects of the invention may become apparent, from consideration of the following description.

BRIEF DESCRIPTION OF THE DRAWINGS

Embodiments of the invention will now be described, by way of example only, with reference to the accompanying drawings, wherein.

DESCRIPTION OF THE PREFERRED EMBODIMENTS

Figure 1:
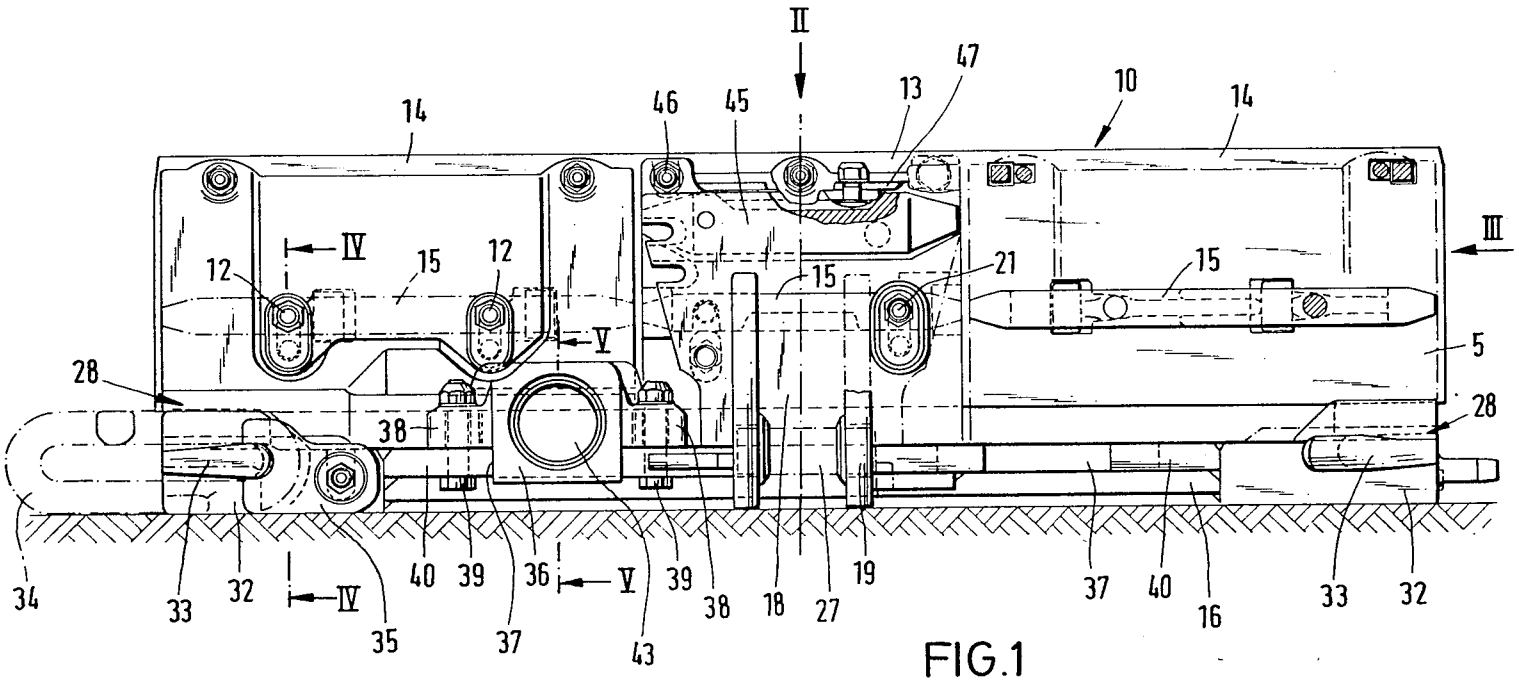
FIG. 1 is a part-sectional side view of part of a mineral mining installation constructed in accordance with the invention.

The mineral mining installations depicted in the accompanying drawings and composed of a scraper-chain conveyor and a plough movable back and forth along the conveyor is similar in many respects to that described in German Patent Specification No P 26 21 382. The plough used in the installations is of the so-called sword plate variety with a drive plate or blade extending beneath the conveyor and driven by a haulage chain from the side of the conveyor remote from the mineral face. The plough is not illustrated in its entirety but in FIG. 3, the drive plate or sword plate is shown diagrammatically and designated 1. Referring initially to FIGS. 1 to 5, the scraper-chain conveyor 2 is composed in known manner of a series of channel sections or pans 3 interconnected end-to-end for relative movement therebetween in vertical and longitudinal directions. A scraper-chain assembly (not shown) is driven along the pans to transfer material stripped from the mineral face by the plough. Each of the conveyor pans is constructed from a pair of sigma-shaped side walls 6, 7 with a floor plate 8 welded therebetween. The drive or sword plate 1 of the plough which may be composed of a number of sections articulated together as is known. The plate 1 connects with one or more guide blocks 4 at the goaf side of the working remote from the mineral face. The blocks 4 engage in a lower chain passage 5 defined by means fitted to the goaf side of the conveyor pans. More particularly, upstanding plates 9 and spacers 15 are fixed to the goaf side walls 6 of the conveyor pans 3 to provide part of a chain guide structure 10 defining the lower passage 5 and an upper passage 11. A drive chain (not shown) circulates within the passages and is connected in the lower passage 5 with the guide block(s) 4. The upper run of the chain in the passage 11 forms the return run while the lower run in the passage 5 forms the haulage run. The guide structure has angular covers 13, 14 which cover the passages 5, 11 from the goaf side. The covers 13, 14 are connected to the conveyor side walls 6 with the aid of bolts 12. Each pan 3 of the conveyor 2 has three covers allocated to it namely a central cover 13 and two end covers 14. The length of each end cover 14 along the conveyor 2 is greater than that of the central cover 13. The conveyor 2 and the chain guide structure 10 which is fitted thereto rest on a floor sub-frame structure having individual floor engaging skids 16 beneath each of the pans 3. These skids 16 combine to form a slide bed or track for the plough and its drive plate 1 more or less continuous along the length of the conveyor 2. Each skid 16 projects outwardly beyond the side wall 7 of the conveyor pan 3 and is cranked downwardly, as at 17 in FIG. 3, towards the floor. These projecting portions of the skids 16 provide a means of limiting the depth of cut of the plough. As the plough passes along the working the conveyor is lifted locally by the passage of the drive plate 1 as depicted diagrammatically in FIG. 3. Stout base units 32 at the end regions of the pans 3 are welded to the skids 16 at the goaf side of the working. Upstanding brackets 18 or consoles are aligned with the central covers 13 and are fixed to the skids 16. The brackets 18 may be integral with the skids 16. The brackets 18 are spaced from the vertical sides of the central covers 13 and have a width (along the conveyor 2) approximately the same as the covers 13. The top surfaces of the brackets 18 are approximately at the same level as the upper horizontal portions of the covers 13, 14. The brackets 18 serve to mount lower connections 19 for known advancing mechanisms 20, usually hydraulic rams, and upper connections 21 for hydraulic control units 22 used to tilt the plough installation to control the attitude and thereby the cutting horizon of the plough. Each connection 19 is conveniently composed of a pair of plates with a pivot pin 27 therebetween. Each connection 21 may mount a multipart socket with threaded bolts 23 to the bracket 18. The piston rod of each unit 22 is attached with an articulated joint 25 to a head piece 26 of the associated mechanism 20.

Figure 4:
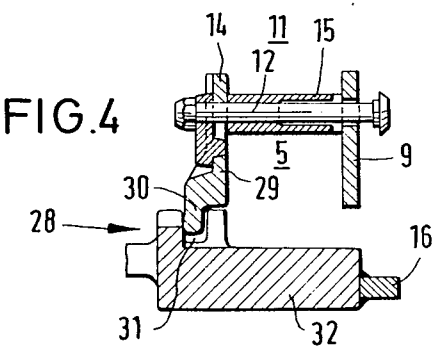
FIG. 4 is a section taken along the line IV—IV of FIG. 1.

The covers 14 are slidably and pivotably connected to the sub-frame structure i.e. the base units 32, the brackets 18 and the skids 16 with tongue-and-groove connections 28. As shown in FIG. 4, the vertical side 29 of each cover 14 has a projection forming a tongue 30 which engages in a groove 31 formed in one of the base units 32 fixed to the associated skid 16. The tongues 30 have a certain degree of free play in the grooves 31 to permit the pan 3 with the parts of the guide structure 10 fixed thereto to be raised and tilted as the drive plate 1 of the plough passes thereby. Once the plate 1 has passed the pan 3 moves down onto the skid 16 until the side wall 7 rests on the skid 16 again. A limited longitudinal displacement of the tongues 30 in the grooves 31 can also occur and this is useful in enabling the installation to cope with an uneven undulating floor or curved workings. The connections 28 are only provided at the ends of the pans 3 where the base units 32 are disposed.

Figure 2:
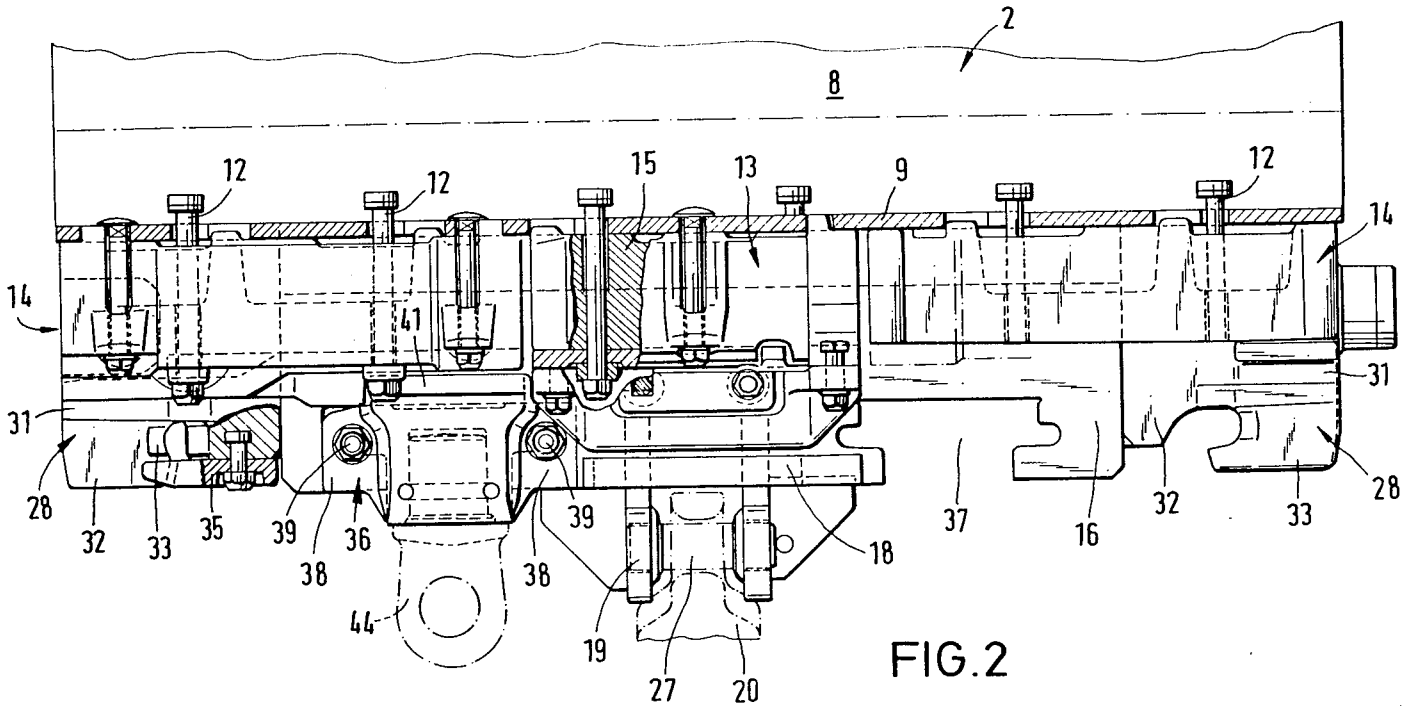
FIG. 2 is a part-sectional plan view of part of the installation taken in the direction of arrow II in FIG. 1.
Figure 3:
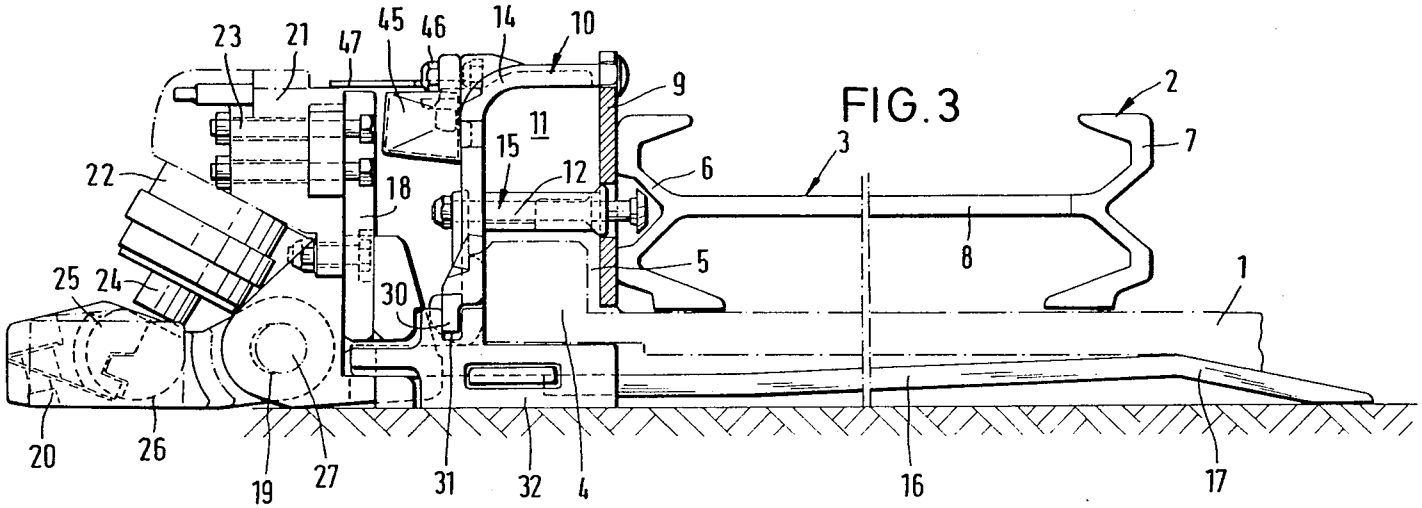
FIG. 3 is a part-sectional view of the installation the view being taken in the direction of arrow III in FIG. 1.
Figure 5:
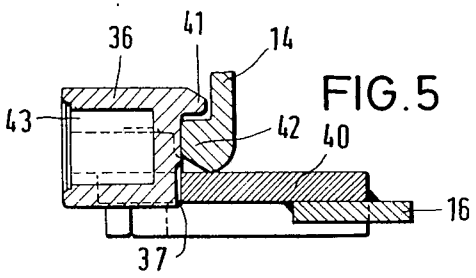
FIG. 5 is a section taken along the line V—V of FIG. 1.

Locking bars 36 are used to secure the connections 28 and prevent the tongues 30 leaving the grooves 31. The skids 16 have shaped pockets 37 between the base units 32 and the brackets 18 as shown in FIG. 2, (where the associated locking bar 36 is omitted). Each locking bar 36 is fitted in the pocket 37 and has lateral flanges 38 secured with bolts 39 to a strip 40 welded to the skid 16. As shown in FIG. 5, noses 41 on the bars 36 engage over lugs 42 on the lower edge of the sides of the covers 14 to hold the tongues 30 in the grooves 31 without inhibiting the longitudinal and tilting movements of the tongues 30. In the space between the brackets 18 and the central cover 13 stop means 45 is provided as shown in FIG. 3 to limit the degree of tilting of the covers 14 and the pans in relation to the skids 16 and other substructure components. As shown in FIG. 1, the stop member 45 can be composed of a bridge piece fitted with bolts 46 near the top of the cover 13 near the bracket 18. A resilient rubber flap 47 or the like can cover over the narrow gap between the bracket 18 and the cover 13.

Couplings 33 are provided on the bases 32 for use in interconnecting the adjacent ends of the skids 16 at the goaf side. As shown in FIG. 2, these couplings 33 are portions or elements of hook-like configuration and chain links 34 are fitted over these coupling elements 33 as shown in FIG. 1. The links 34 are locked in place with screwed-on plates 35.

The locking bars 36 which hold down the tongues 30 as described can be stout components and can serve as a mounting for further components. To this end the bars 36 may have openings 43 (FIG. 5) for pivot pins 44 (FIG. 2) of hydraulic bracing rams for example. Forces are then transmitted via the pins 44 to the bars 36 which are of robust construction, reliably secured to the skids 16.

The covers 14 are readily accessible from the goaf side of the installation and after release and removal of the bars 36 and release of the bolts 12, the covers 14 can be lifted clear for access to the interior of the passages 5, 11 and the chain therein. The base units 32, which are preferably strong rigid castings, serve to interconnect the skids 16 and connect the conveyor and guide to the sub-frame structure via the connections 28.

Figure 6:
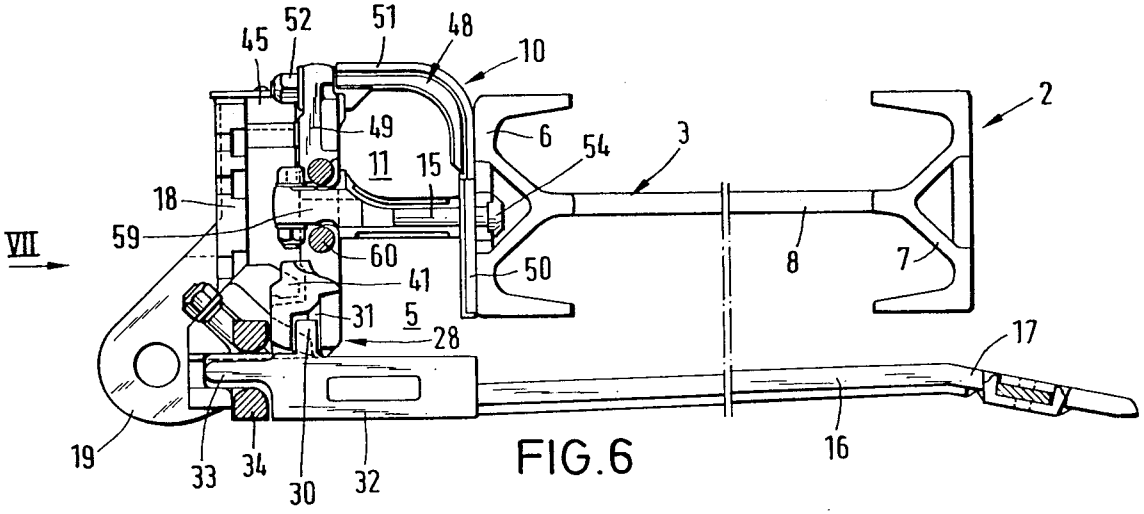
FIG. 6 is a part-sectional end view of part of another installation constructed in accordance with the invention.
Figure 9:
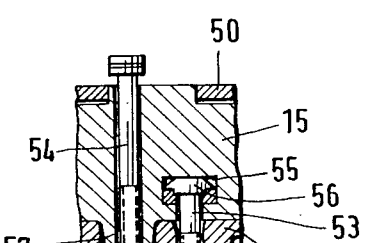
FIG. 9 is a section taken along the line IX—IX of FIG. 7.
Figure 7:
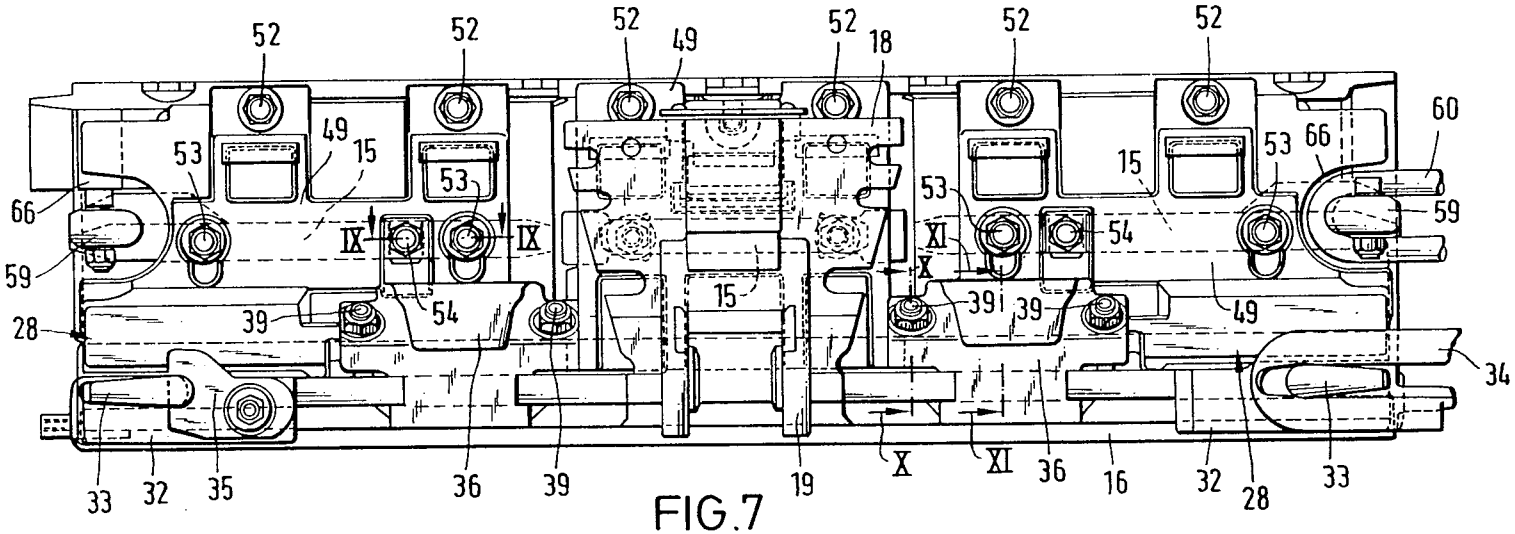
FIG. 7 is a part-sectional side view of part of the installation shown in FIG. 6, the view being taken in the direction of arrow VII of FIG. 6.

FIGS. 6 to 11 depict a modified construction in which like reference numerals are used to denote similar parts to FIGS. 1 to 5. In the modified embodiment shown in FIGS. 6 to 11, the guide structure 10 is composed of somewhat different covers 48, 49 with three covers 49 allocated to each pan 3. The covers 48 are again L-shaped angle plates but here inverted and bolted with their upstanding walls to the side walls 6 of the pans 3. The top walls 51 of the covers 48 project over the upper chain guide passage 11. The covers 49 which are preferably castings, cover over the passages 5, 11 laterally from the goaf side. The covers 49 are connected with bolts 52 to the top walls 51 of the covers 48 and by means of bolts 53 to the spacers 15 which are themselves fastened to the side walls 6 with bolts 54 as shown in FIGS. 7 and 9. The covers 49 are provided with bores for receiving these bolts 52, 53. As shown in FIG. 9, the spacers 15 have recesses 55 which receive the heads 56 of the bolts 53. The spacers 15 also have stud-like projections 57 through which the bores for the bolts 54 extend. The projections 57 engage in apertures 58 in the covers 49 to provide a shape-locked engagement supplementing the bolted connections.

Figure 8:
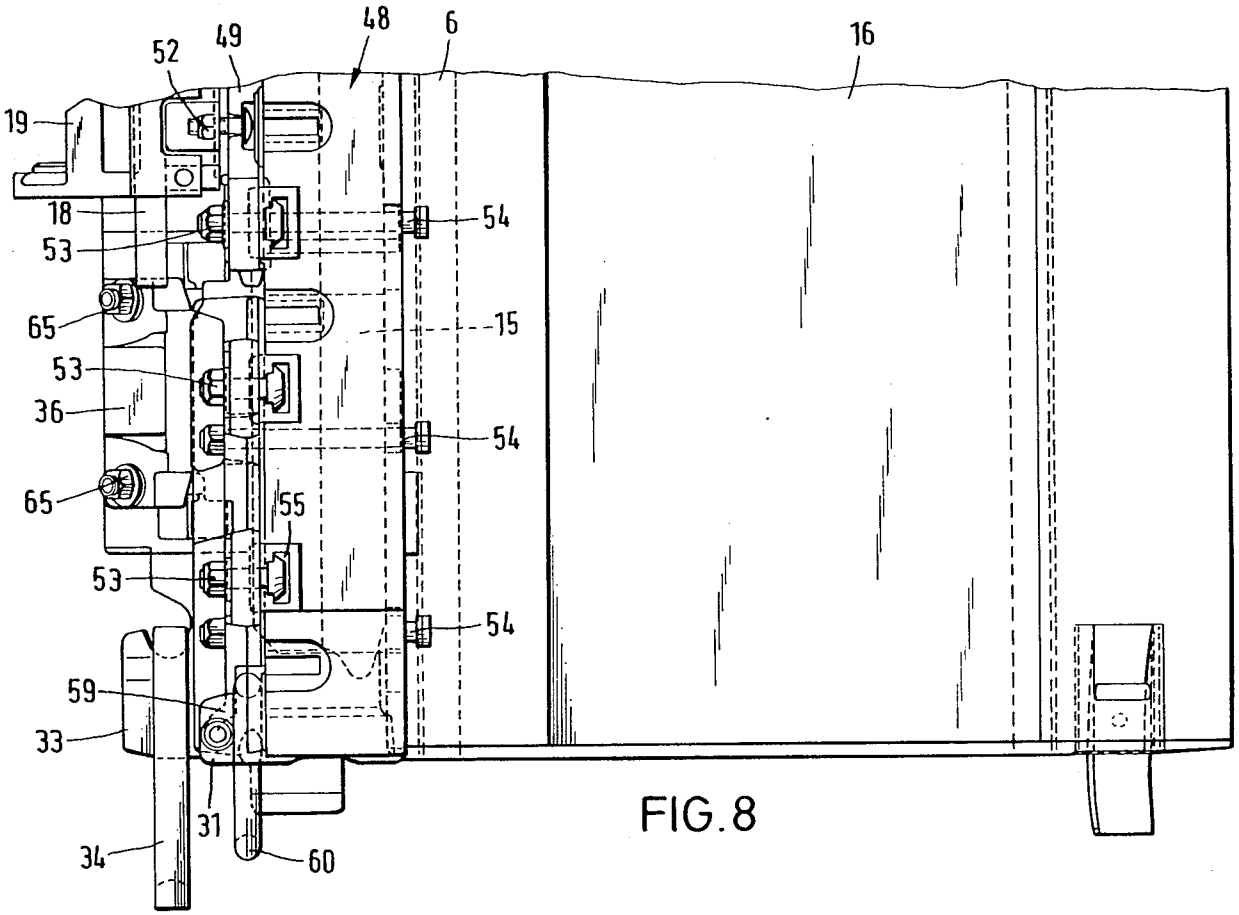
FIG. 8 is a plan view of the part of the installation depicted in FIG. 6.

The spacers 15 at the ends of the pans 3 have hook-like portions 59 which as shown in FIGS. 6, 7 and 8 receive chain links 60 to interconnect the pans 3. Recesses 66 in the end covers 49 provide seats for the links 60 and as in the first-described embodiment, the links 60 can be retained by screwed-on locking plates. The covers 49 can easily be removed after release of the bolts 52, 53 without detachment of the spacers 15 and when the covers 49 are removed there is good access to the passages 5, 11 and the drive chain. The tongue-and-groove-connections 28 are only provided on the covers 49 at the ends of the pans 3. In this modified embodiment the tongues 30 of the connections 28 are provided on the skids 16 or the welded-on base units 32 which are again robust castings. In this case the tongues 30 take the form of ribs which engage with the necessary clearance in the grooves 31 in the bottoms of the end covers 49. These connections 28 are particularly easy to fabricate and also ensure that the inside surfaces of the covers 49 bounding the passage 5 provides good guidance for the guide block(s) 4. Tilt limiting means 45 is provided between the central bracket 18 and the central cover plate 49.

Figure 11:
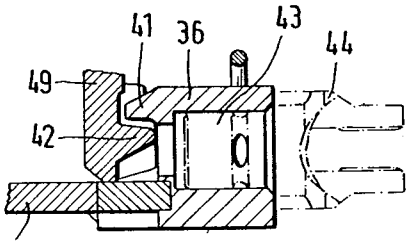
FIG. 11 is a section taken along the line XI—XI of FIG. 7.
Figure 10:
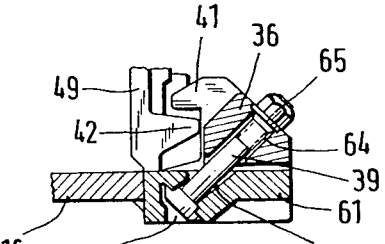
FIG. 10 is a section taken along the line X—X of FIG. 7.

The locking bars 36 which hold the components of the connections 28 together are again provided with noses 41 engaging over lugs 42 on the cover plates 49 but the bars are fixed with inclined bolts 39 as shown in FIGS. 10 and 11. The skids 16 are provided with welded-on reinforcements 61 which have inclined bores 62 with bolt-head pockets 63 for holding the heads of the bolts 39 captive. The locking bars 36 also have inclined bores 64 for receiving the bolts 39. During assembly the bolts heads are inserted in the pockets 63, the bars 36 are placed onto the shanks of the bolts 39 and nuts 65 are fitted and tightened. This inclined disposition for the bolts permits easy assembly and dismantling of the bars 36 even in thin-seam workings where conditions are especially cramped.

We claim:

1. A mineral mining installation comprising a scraper-chain conveyor composed of individual channel sections arranged end-to-end; means defining upper and lower chain guide passages at one side of the conveyor remote from a mineral face being worked; said passage-defining means including detachable covers fitted to the channel sections of the conveyor; at least some of the covers having lugs provided on the lower regions thereof; a floor sub-frame structure disposed beneath the conveyor; a mineral winning machine having a drive plate projecting between the conveyor and the sub-frame structure and slidable along the sub-frame structure; guide means in the lower guide passage connecting the drive plate to a drive chain running through the upper and lower passages; and connection means between said at least some of the covers and the sub-frame structure to permit both raising and tilting movements of the passage-defining means and adjacent sides of the channel sections of the conveyor to a limited extent in relation to the sub-frame structure in response to the passage of the drive plate; wherein the connection means takes the form of tongue-and-groove connections and locking bars are provided to maintain the tongues within the grooves, the locking bars being detachably connected to the sub-frame structure and having portions which overlap with the lugs on the lower regions of the covers.

2. An installation according to claim 1, wherein the sub-frame structure takes the form of skid plates and floor-engaging base units disposed at the ends of the channel sections remote from the winning machine connected to the skid plates and the connection means takes the form of grooves in the base units and tongues depending from side walls of the covers remote from the conveyor.

3. An installation according to claim 1, wherein the sub-frame structure takes the form of skid plates and floor-engaging base units disposed at the ends of the channel sections remote from the winning machine connected to the skid plates and the connection means takes the form of upstanding tongues on the base units and grooves in the lower edges of side walls of the covers remote from the conveyor.

4. An installation according to claim 1, wherein the sub-frame structure also has shaped pockets for locating the locking bars.

5. An installation according to claim 1, wherein the locking bars are detachably connected to the sub-frame structure with the aid of inclined bolts.

6. An installation according to claim 5, wherein the sub-frame structure has shaped recesses for receiving heads of the inclined bolts.

7. An installation according to claim 1, wherein the locking bars are provided with means for permitting attachment of other ancilliary components thereto.

8. An installation according to claim 1, wherein only the covers at the ends of each channel section have the tongue-and-groove connections.

9. An installation according to claim 1, wherein the defining means further comprises Lshaped plates with main walls fixed to side walls of the channel sections remote from the winning machine and top walls extending over the upper chain guide passage and wherein the covers define the lateral sides of the upper and lower passage remote from the channel section side walls and means is provided to detachably secure the covers to the L-shaped plates.

10. An installation according to claim 9, wherein the defining means further comprises spacers fitted to the side walls of the channel sections remote from the winning machine to separate the upper and lower passages in a vertical sense and wherein the covers are additionally detachably secured to at least some of the spacers.

11. An installation according to claim 10, wherein said at least some spacers have stud-like projections engaged in recesses in the covers.

12. An installation according to claim 10, wherein the spacers located at the end regions of the channel sections have shaped hook-like portions for receiving links used to interconnect the channel sections in a flexible manner.

13. An installation according to claim 12, wherein the covers at the end regions of the channel sections have recesses in which the links are seated.

14. An installation according to claim 1, wherein each channel section of the conveyor has three covers and the sub-frame structure includes upstanding brackets each intermediate the ends of each channel section and spaced from the side of a central one of the covers, the brackets having connection means for permitting advancing ram mechanisms to be connected therewith.

15. An installation according to claim 14, wherein at least some of the brackets have further connection means above the first-mentioned connection means for permitting attachment to hydraulic control units used to tilt part of the installation and adjust the cutting horizon of the winning machine.

16. An installation according to claim 1, wherein the sub-frame structure takes the form of skid plates welded to floor engaging base units, said base units being disposed at the end regions of the channel sections and having hook-like coupling pieces which receive links used to interconnect the skid plates.

17. An installation according to claim 1, wherein the connection means also permits limited longitudinal movement between the sub-frame structure and the passagedefining means.

18. An installation according to claim 1 and further comprising means for limiting the degree of tilting of the covers and the channel sections relative to the sub-frame structure.

* * * * *